US006761415B2

(12) United States Patent
Sabatie et al.

(10) Patent No.: US 6,761,415 B2
(45) Date of Patent: Jul. 13, 2004

(54) TRAILER FOR A TUNNEL BORER FOLLOWER TRAIN

(75) Inventors: Jean-Marc Sabatie, Verdun sur Garonne (FR); Frédéric Daugenne, Castelginest (FR); Jean-Yves Padovanni, Bruguieres (FR)

(73) Assignee: Compagnie du Sol, Nanterre (FR)

( * ) Notice: Subject to any disclaimer, the term of this patent is extended or adjusted under 35 U.S.C. 154(b) by 62 days.

(21) Appl. No.: 10/081,323

(22) Filed: Feb. 22, 2002

(65) Prior Publication Data

US 2002/0117886 A1 Aug. 29, 2002

(30) Foreign Application Priority Data

Feb. 26, 2001 (FR) ..... 01 02556

(51) Int. Cl.[7] ..... E21D 9/12

(52) U.S. Cl. ..... 299/1.9; 299/1.05; 299/95; 180/41; 280/755; 405/138

(58) Field of Search ..... 180/41, 314; 280/755; 299/1.9, 1.05, 95; 105/199.2; 405/138; 701/124

(56) References Cited

U.S. PATENT DOCUMENTS 3,902,691 A * 9/1975 Ott ..... 105/164

4,872,118 A * 10/1989 Naidenov et al. ..... 114/124

FOREIGN PATENT DOCUMENTS

| | | | |
|---|---|---|---|
| DE | 433 17 516 A1 | 5/1993 | ..... E21D/9/12 |
| FR | 1383763 | 6/1963 | |

OTHER PUBLICATIONS

Preliminary search report (in French) dated Nov. 6, 2001, 2 pp.

* cited by examiner

*Primary Examiner*—John Kreck
(74) *Attorney, Agent, or Firm*—Cohen, Pontani, Lieberman & Pavane

(57) ABSTRACT

A trailer for a tunnel borer follower train comprises a chassis provided with a plurality of wheels, the chassis at rest presenting a longitudinal axis and a longitudinal plane of symmetry that is vertical. The trailer also comprises at least two tanks mounted on the chassis substantially symmetrically about the longitudinal plane of symmetry of the chassis; apparatus for measuring any tilt of the chassis of the trailer about its longitudinal axis; apparatus for feeding both tanks with liquid; and apparatus for controlling the quantity of liquid in each of the tanks as a function of any measured tilt in such a manner that the quantity of liquid contained in each tank creates a return torque about the longitudinal axis tending to compensate for any tilt of the trailer.

5 Claims, 5 Drawing Sheets

TRAILER FOR A TUNNEL BORER FOLLOWER TRAIN

BACKGROUND OF THE INVENTION

When making tunnels of large dimensions and also of considerable length, it is common practice to use a "tunnel borer" enabling the entire cutting front to be bored simultaneously. The tunnel borer proper is fitted with a follower train made up of trailers in the form of small cars pulled by the tunnel borer. These trailers are used firstly for transporting various elements that are needed for making the tunnel while it is being bored, such as voussoirs which are put into place to prop up the tunnel wall, and also to remove the cuttings that result from the tunnel boring action proper.

These trailers are fitted with wheels that run directly on the cylindrical wall of the tunnel without any guide rails being interposed. It will be understood that if a trailer is not loaded symmetrically about its longitudinal plane or if the tunnel presents a degree of curvature in a horizontal plane, then the wheels of trailers which are not swivel-mounted will cause the entire trailer to take on a certain amount of tilt, which must be corrected. It will be understood that for proper operation, it is necessary for the trailers of a follower train to be substantially horizontal, in particular for satisfactory transfer of the cuttings that are extracted by the tunnel borer.

OBJECTS AND SUMMARY OF THE INVENTION

There therefore exists a real need to have a system which enables a trailer of a follower train to be maintained substantially horizontal while nevertheless constituting a technique that is simple and that acts simply.

An object of the present invention is to provide a trailer for a tunnel borer follower train satisfying the conditions specified above.

According to the invention, this object is achieved by a trailer for a tunnel borer follower train, the trailer comprising a chassis provided with a plurality of wheels defining an advance direction for the trailer, said chassis at rest presenting a longitudinal axis and a longitudinal plane of symmetry that is vertical, the trailer further comprising:

- at least two tanks mounted on the chassis substantially symmetrically about the longitudinal plane of symmetry of the chassis;
- means for measuring any tilt of the chassis of the trailer relative to the horizontal about its longitudinal axis;
- means for feeding the two tanks with liquid; and
- means for controlling the quantity of liquid in each tank as a function of any measured tilt in such a manner that the quantity of liquid contained in each tank creates a return torque about the longitudinal axis tending to compensate any tilt of said trailer.

It will be understood that by permanently controlling the mass of liquid in each of the side tanks of the trailer, it is possible to create a return torque as a function of the indications from the tilt meter fitted to the trailer so as to establish a return torque which enables the trailer to be returned progressively to a substantially horizontal position as it advances. The chassis of the trailer is returned to the horizontal position by its wheels slipping sideways under the effect of the return torque. It will also be understood that the system does not have any complex components, but merely the tanks for receiving and storing the liquid and systems of solenoid valves controlled by a central unit so as to adjust the volume of liquid contained in each of the two tanks.

In a preferred embodiment, the liquid used for filling the tanks in controlled manner is the same as the liquid used for feeding the cooling circuit of the tunnel borer itself.

It will be understood that in this embodiment, the liquid used performs two functions, namely that of cooling the tunnel borer and also that of enabling a return torque to be established for keeping the trailer of the tunnel borer follower train substantially horizontal.

BRIEF DESCRIPTION OF THE DRAWINGS

Other characteristics and advantages of the invention will appear better on reading the following description of various embodiments of the invention given as non-limiting examples. The description refers to the accompanying figures, in which.

MORE DETAILED DESCRIPTION

Figure 1:
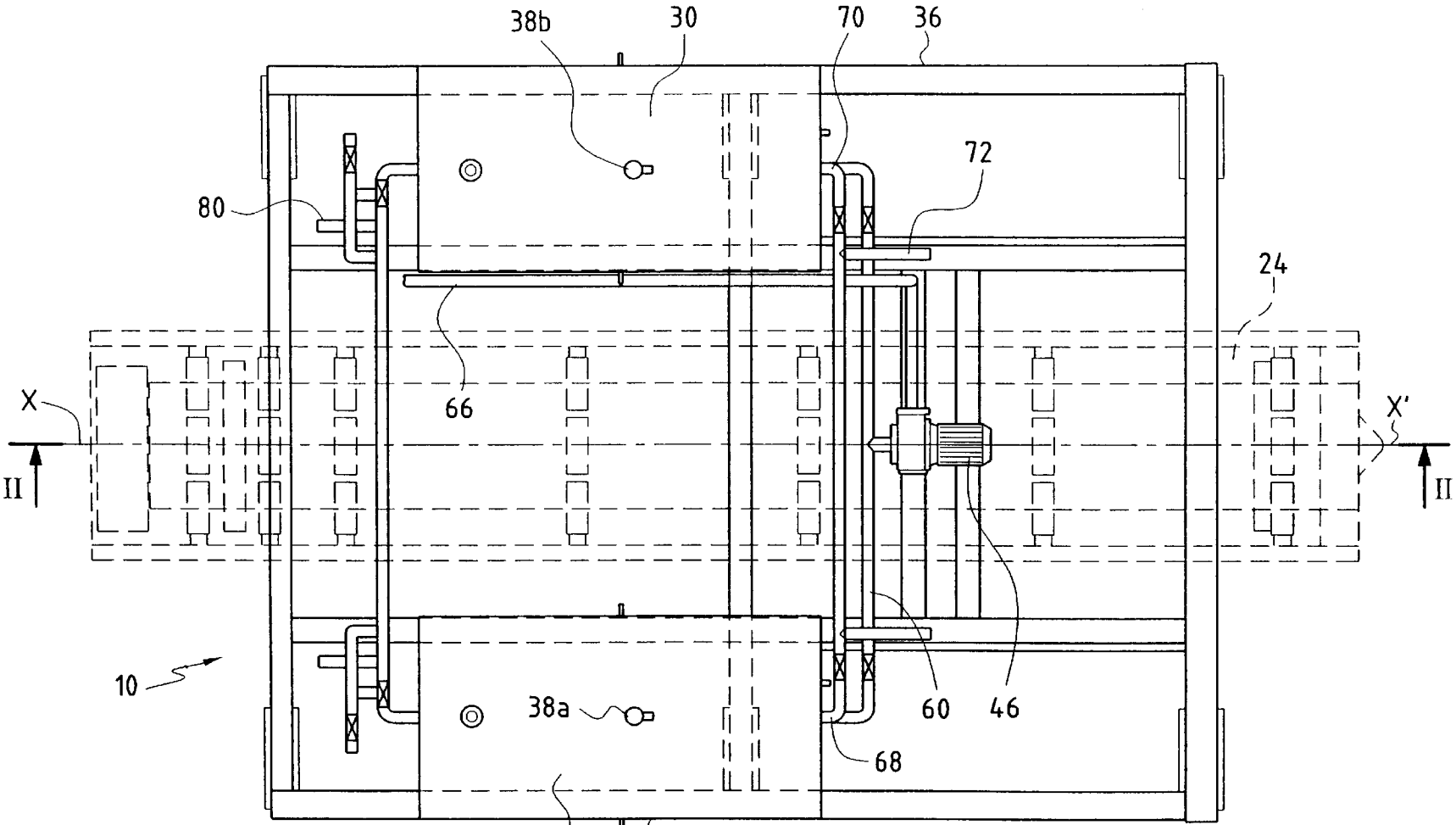
FIG. 1 is a plan view of a trailer of a follower train.
Figure 2:
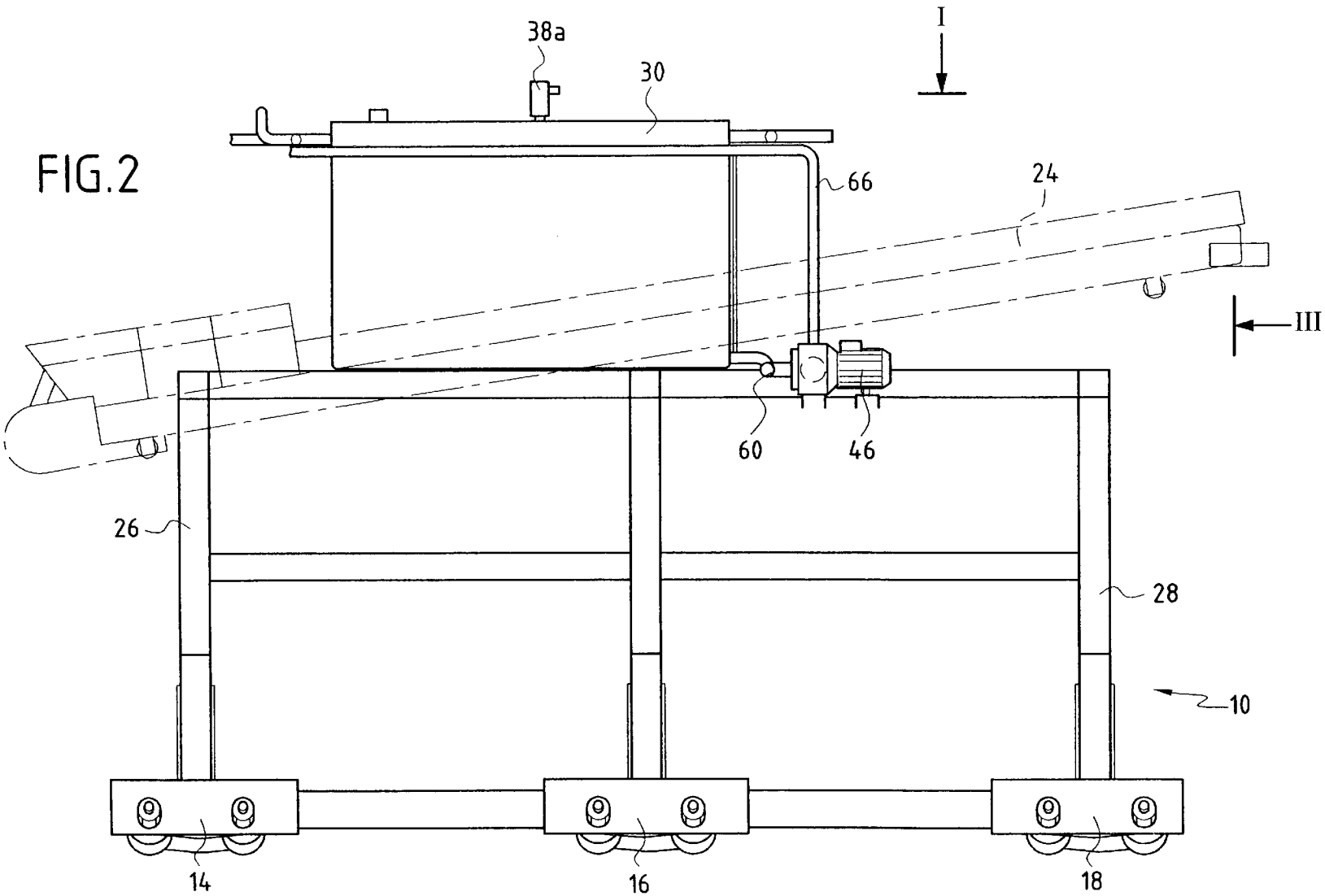
FIG. 2 is a fragmentary vertical section view on line II-II of FIG. 1.
Figure 3A:
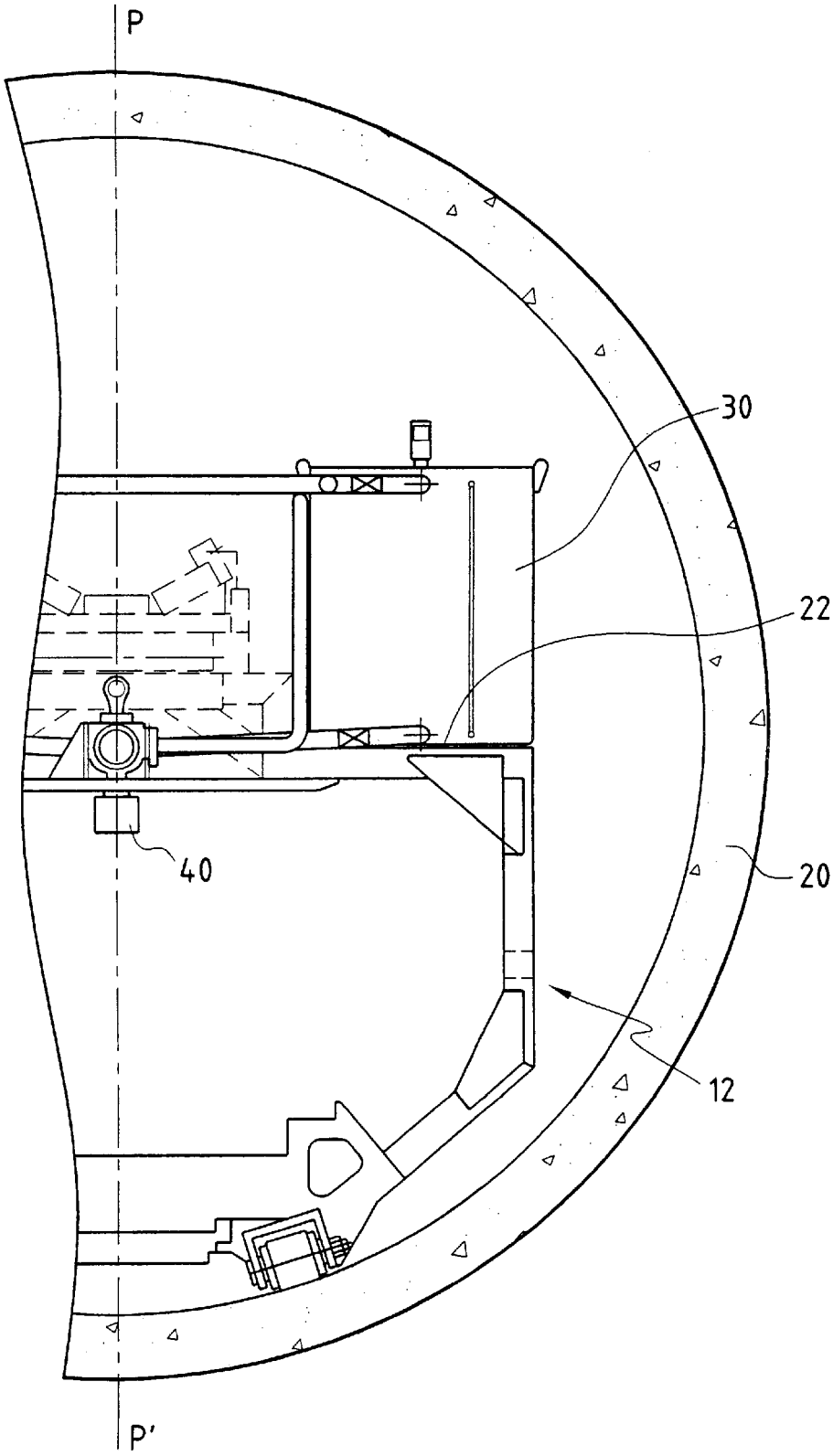
FIGS. 3A and 3B are respectively right and left half-views in elevation of the trailer of the follower train.
Figure 3B:
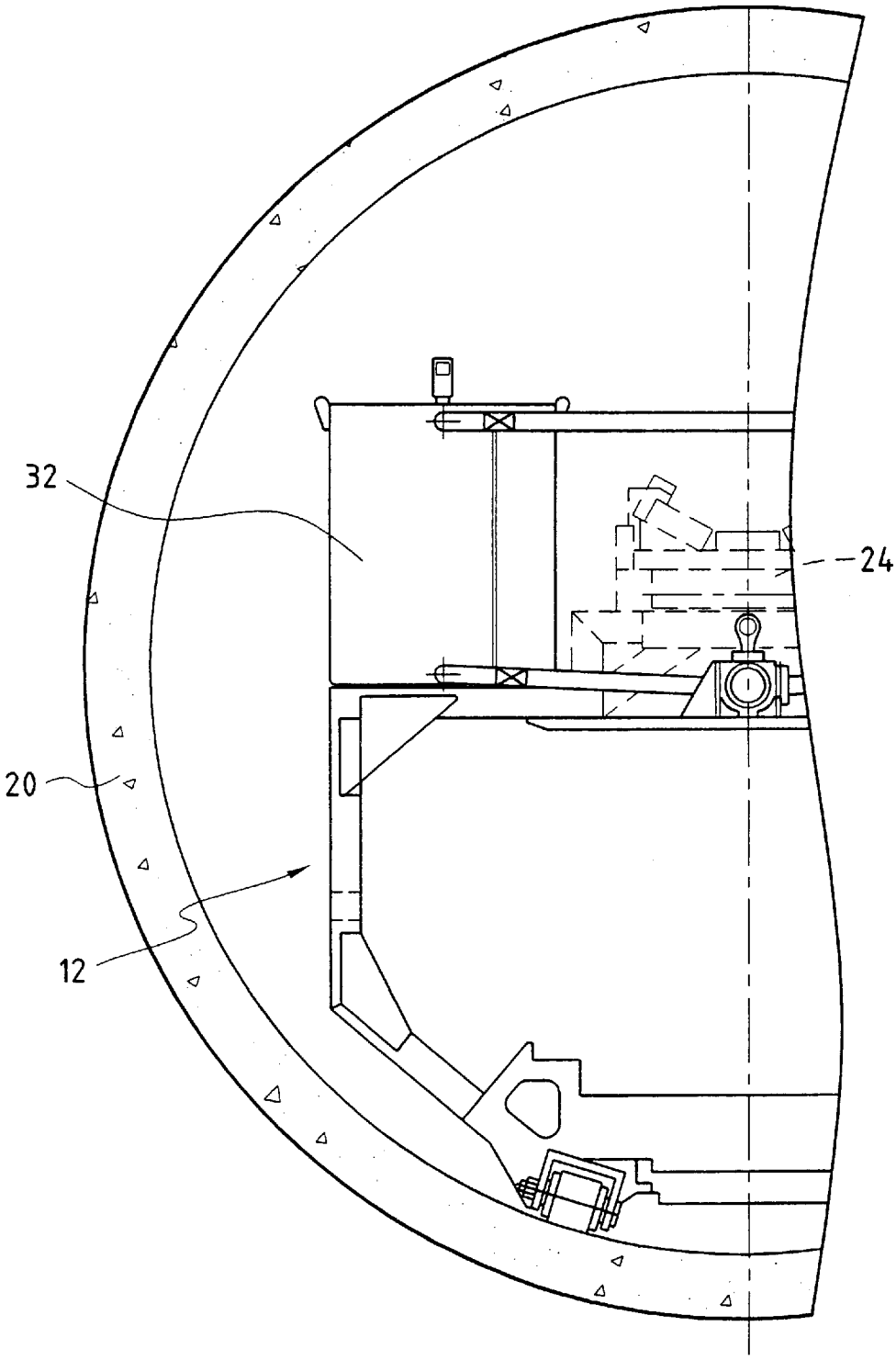

Reference is made initially to FIGS. 1 to 3 while describing a preferred embodiment of the trailer for a tunnel borer follower train.

The trailer essentially comprises a chassis 12 presenting a horizontal longitudinal axis XX' and a midplane PP' that is vertical when the trailer is at rest. The chassis 12 is fitted at its bottom end with a plurality of wheels, or preferably of pairs of wheels such as 14, 16, and 18 which enable the trailer 10 to run along the cylindrical wall 20 of the tunnel.

In its top portion 22, the chassis 12 of the trailer is fitted in particular with a conveyor 24 for transferring cuttings from the front end 26 of the trailer to its rear end 28.

So far as the present invention is concerned, there is no need to describe in detail the manner in which the chassis 12 of the trailer is made in terms of the equipment it includes, specifically for transferring and handling voussoirs.

On its top portion 22, the trailer is fitted with two preferably identical tanks 30 and 32 mounted symmetrically about the longitudinal axis XX' of the trailer. These tanks are disposed along outside longitudinal edges 34 and 36 of the trailer chassis. By way of example, each tank can be generally in the form of a rectangular parallelepiped with a capacity of 1500 liters. Each tank 30 or 32 is preferably fitted with a respective sensor 38*a* or 38*b* for measuring the level of liquid in each tank 30 or 32. In addition, a tilt meter given reference 40 is fitted to the top portion 22 of the follower train trailer so as to supply a signal S representative of any tilt of the trailer.

It will be understood that in accordance with the principle of the present invention, each of the two tanks 30 and 32 is filled with a suitable quantity of water for establishing a return torque to compensate for tilt of the trailer as measured by the tilt meter 40. Naturally, at rest, i.e. when the trailer has a midplane PP' which is vertical, the tanks 30 and 32 are half filled with liquid.

Figure 4:
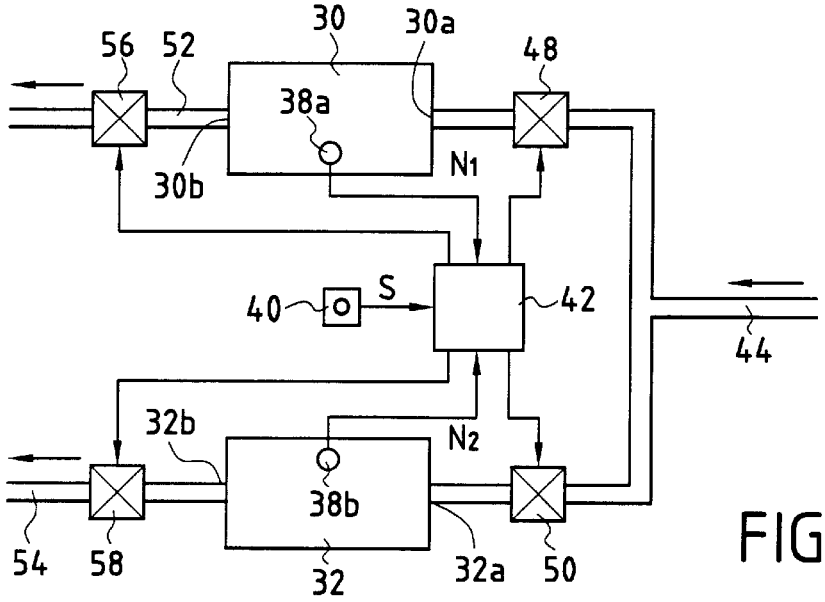
FIG. 4 shows a simplified circuit for feeding the liquid tanks of the trailer.

With reference initially to FIG. 4, a simplified embodiment of the circuit for feeding the tanks 30 and 32 with liquid is described. This figure shows a central processor unit 42 which receives the tilt signal S delivered by the tilt meter 40 together with the signals $N_1$ and $N_2$ delivered by the level sensors 38*a* and 38*b* mounted in the tanks 30 and 32. Depending on the measured tilt, the central unit 42 controls the liquid levels $N_1$ and $N_2$ in the two tanks so as to generate a suitable return torque.

In this simplified embodiment, the liquid, which is preferably water, arrives via a main pipe 44. This pipe 44 feeds respective inlets 30*a* and 32*a* of the tanks 30 and 32 via solenoid valves 48 and 50. The tanks 30 and 32 also have respective outlet openings 30*b* and 32*b* respectively connected to outlet pipes 52 and 54 each fitted with a solenoid valve 56 and 58.

It will be understood that in this simplified embodiment, starting from the tilt information S, the central unit 42 calculates a difference between the levels $N_1$ and $N_2$ for generating a return torque, and this difference in level is used for controlling the filling valves 48 and 50 or the emptying valves 56 and 58 so as to adapt the level in each tank to the desired level difference corresponding to a difference in mass in the tanks 30 and 32 that is suitable for producing the return torque.

Figure 5:
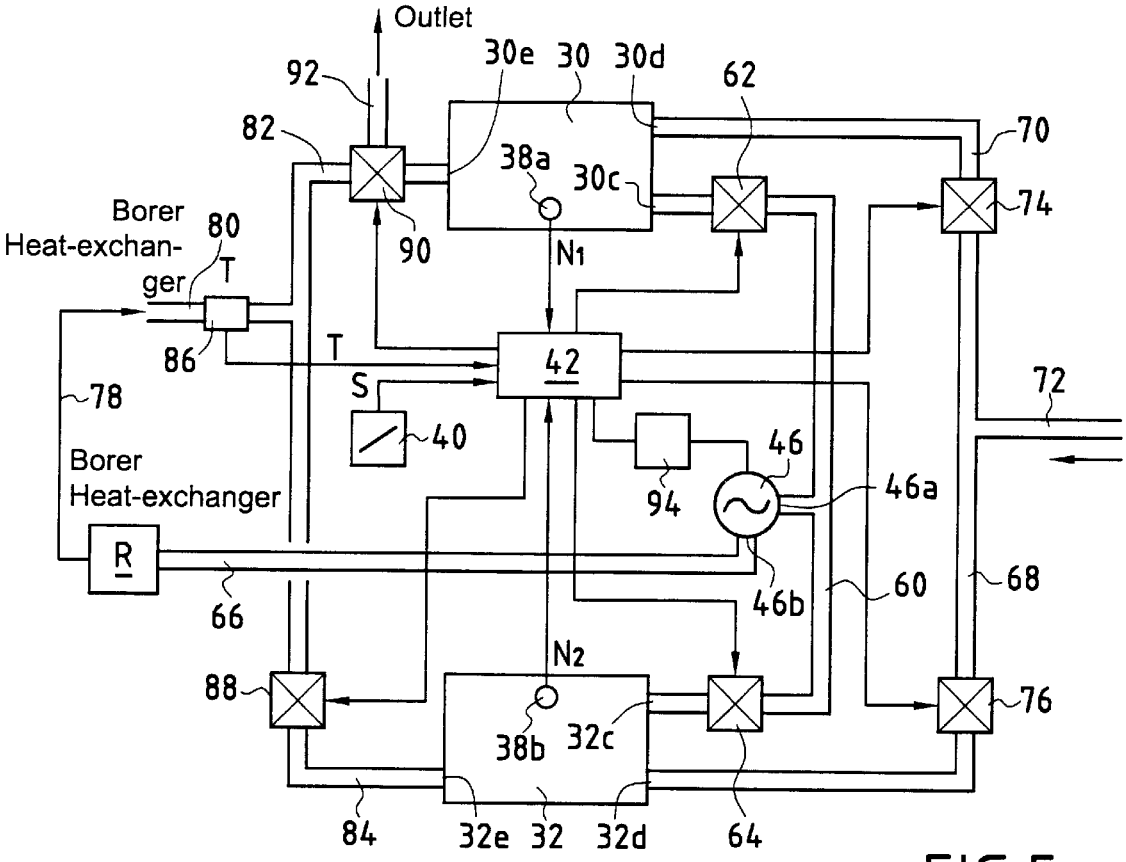
FIG. 5 shows the circuit for feeding liquid to the balancing tanks when said liquid is also used for cooling the tunnel borer.

FIG. 5 shows an improved embodiment of the feed circuits for the tanks 30 and 32 which also serve to provide at least part of the cooling for the liquid circulating in the heat exchanger of the tunnel borer. In this embodiment, the tanks 30 and 32 thus serve, as already explained, to create a return torque due to the different masses of liquid they contain, and they also serve as heat exchangers for providing at least some of the cooling required by the cooling liquid of the tunnel borer. This circuit has in addition a pump 46 whose inlet 46*a* is connected to a first pipe 60 leading to the outlet orifices 30*c* and 32*c* from the tanks 30 and 32 via solenoid valves 62 and 64. The outlet 46*b* of the pump 46 is connected to a pipe 66 feeding the cooling circuit R of the tunnel borer. Each tank also has a first liquid inlet 30*d*, 32*d* which is connected via pipes 68, 70, and 72 to an external source of cold liquid. The pipes 70 and 68 are fitted with solenoid valves 74 and 76. The outlet pipe 78 from the cooling circuit R of the tunnel borer is connected by pipes 80, 82, and 84 to a second inlet orifice 30*e* or 32*e* of the tanks 30 and 32. The pipe 80 is fitted with a temperature sensor 86 and the pipes 82 and 84 are fitted with a first solenoid valve 88 constituting an on/off valve and a second solenoid valve 90 having three ports. The valve 90 also serves to control an outlet flow rate into a pipe 92 leading to outside the trailer to serve as a general outlet pipe for the liquid.

In addition, the tanks 30 and 32 are fitted with level sensors 38*a* and 38*b* and the trailer is fitted with its tilt meter 40. There can also be seen a central control unit 42 which receives the signal S as delivered by the tilt meter 40, the temperature measurement T as delivered by the temperature sensor 86, and the level measurements $N_1$ and $N_2$ as delivered by the level sensors 38*a* and 38*b* sensing the levels in the tanks 30 and 32. The outlets from the central control unit 42 serves to control the solenoid valves 62, 64, 74, 76, 88, and 90. The central unit also serves to control the circuit 94 controlling the pump 46.

Before describing the operation of the liquid circuit in detail, it can be stated in general terms that when the temperature of the liquid coming from the tunnel borer heat exchanger via the pipe 78 is below a predetermined value $T_R$, then this is the liquid which is used for filling the tanks 30 and 32 in order to establish the return torque. In contrast, if the measured temperature T is greater than the reference temperature $T_R$, then it is cold liquid coming via the pipe 72 that is used for adjusting the liquid levels $N_1$ and $N_2$ in the tanks 30 and 32.

By way of example, the reference temperature $T_R$ is equal to 40° C.

The operation of the hydraulic circuit shown in FIG. 5 is described in detail below. When the temperature of the liquid leaving the tunnel borer heat exchanger as measured by the sensor 86 is less than $T_R$, the central unit 42 causes the valve 88 to be opened and controls the valve 90 in such a manner that the inlet 30*e* of the tank 30 is connected to the pipe 80. Simultaneously, the valves 74 and 76 are closed so as to interrupt the flow of liquid coming from the cold source via the pipe 72. Depending on the indications from the tilt meter 40, the valves 88, 90, and 62 and 64 are controlled so as to maintain a difference between the levels $N_1$ and $N_2$ in the tanks so as to create a return torque while still allowing liquid to flow through the tanks 30 and 32 at a rate that is suitable for cooling the liquid flowing through the heat exchanger of the tunnel borer. This circulation is driven by the pump 46.

If the temperature of the liquid leaving the heat exchanger R of the tunnel borer as measured by the sensor 86 is greater than $T_R$, then the central unit 42 closes the valve 88 and puts the pipe 82 into communication with the outlet pipe 92 via the valve 90. In this configuration, the liquid leaving the heat exchanger R of the tunnel borer leaves directly via the outlet pipe 92. The levels $N_1$ and $N_2$ in the tanks 30 and 32 are then adjusted using the cold liquid feed source connected to the pipe 72. The rates at which liquid flows through the tanks are adjusted in such a manner as to enable the pump 46 to continue to feed the heat exchanger R of the tunnel borer while maintaining a suitable difference in level in the tanks 30 and 32 to create the return torque that corresponds to the tilt as measured by the sensor 40. These flow rates are controlled by means of the valves 70, 76, and 62, and 64. The pipes shown in FIG. 5 are also shown in FIGS. 1 to 3.

Naturally, it would not go beyond the invention for the trailer to have more than two tanks distributed along the longitudinal edges 34 and 36 of the chassis, with these right and left tanks being controlled overall in the same manner as the tanks 30 and 32.

Nor would it go beyond the scope of the invention for the masses of liquid present in the tanks or disposed respectively to the right and to the left of the chassis of the trailer to be controlled not by means of devices for measuring the levels in the tanks, but by measuring flow rates. Under such circumstances, flow rate sensors can be mounted in the pipes, respectively the inlet and outlet pipes of the tanks, so as to ensure a differential flow rate while correcting tilt and then a zero differential flow rate once tilt has been corrected, with the absolute flow rate then being controlled in such a manner as to feed the heat exchanger of the tunnel borer in appropriate manner.

The above-described system for maintaining a horizontal attitude is preferably fitted to the leading trailer, with coupling between trailers being such that the return torque created by the tanks 30 and 32 of the leading trailer is transmitted to the other trailers.

What is claimed is:

1. A trailer for a tunnel borer follower train, the trailer comprising a chassis provided with a plurality of wheels defining an advance direction for the trailer, said chassis at rest presenting a longitudinal axis and a longitudinal plane of symmetry that is vertical, the trailer further comprising:

at least two tanks mounted on the chassis substantially symmetrically about the longitudinal plane of symmetry of the chassis;

means for measuring any tilt of the chassis of the trailer relative to the horizontal about its longitudinal axis;

means for feeding the two tanks with liquid; and means for controlling the quantity of liquid in each tank as a function of any measured tilt in such a manner that the quantity of liquid contained in each tank creates a return torque about the longitudinal axis tending to compensate any tilt of said trailer.

2. A trailer according to claim 1, wherein each tank includes means for measuring the level of liquid in the tank, and wherein the liquid controlling means comprise means for ensuring that the quantity of liquid in each tank corresponds to levels related to the measured tilt.

3. A trailer according to claim 1, for a tunnel borer that includes a cooling liquid circuit, wherein the liquid used for feeding said tanks constitutes at least part of the liquid for cooling said tunnel borer.

4. A trailer according to claim 3, wherein the means for feeding said tanks with liquid comprise means for measuring the temperature T of the tunnel borer cooling liquid; means for comparing the temperature T with a predetermined temperature $T_R$; means for feeding said tanks with said cooling liquid if $T<T_R$; and means for feeding said tanks from an external source of cold liquid if $T>T_R$.

5. A trailer according to claim 3, wherein the means for feeding the tanks with liquid comprise pipes for feeding said tanks and fitted with respective controllable valves, and outlet pipes connected to said tanks, said outlet pipes being connected to the inlet of a pump via controllable valves, the outlet from said pump being connected to the cooling circuit of the tunnel borer.

* * * * *